United States Patent [19]

Janszen

[11] Patent Number: 4,573,679

[45] Date of Patent: Mar. 4, 1986

[54] WATER POWERED BATTING DEVICE

[76] Inventor: Jeffrey G. Janszen, 5686 Scarborough Dr., Cincinnati, Ohio 45238

[21] Appl. No.: 624,021

[22] Filed: Jun. 25, 1984

[51] Int. Cl.[4] ..... A63B 69/40

[52] U.S. Cl. ..... 273/26 E; 272/1 B

[58] Field of Search ..... 273/26 E, 26 R, 181 R, 273/184 B, 413, 414; 272/75, 1 B, 31 B, 31 A, 74

[56] References Cited

U.S. PATENT DOCUMENTS 983,315 2/1911 Rubens ..... 273/26 E 3,408,070 10/1968 Gonzales et al. ..... 273/26 E 3,481,600 12/1969 Lang, Sr. et al. ..... 272/74

3,612,522 10/1971 Ekonen ..... 272/75

4,322,075 3/1982 Hynes ..... 273/26 E

*Primary Examiner*—Richard C. Pinkham

*Assistant Examiner*—T. Brown

*Attorney, Agent, or Firm*—Frost & Jacobs

[57] ABSTRACT

The present invention is a baseball batting device in which a tethered ball is rotated by water propulsion, the water propulsion being provided by a nozzle coupled to an ordinary garden hose, the nozzle causing a squirrel cage to rotate, which in turn causes the tethered ball to rotate. When the ball is struck by a bat, the squirrel cage rotates in the opposite direction and water is flung outwardly in a wide pattern.

16 Claims, 9 Drawing Figures

WATER POWERED BATTING DEVICE

BACKGROUND OF THE INVENTION

1. Field of the Invention

The present invention relates to a baseball amusement device and more particularly to a water powered rotational baseball batting device in which the force of water issuing from a nozzle causes a tethered baseball to rotate so that it may be struck by a bat, paddle or the like.

2. Prior Art

Baseball batting devices are well known and span a broad range of devices from the most simplistic to the most complex. Some devices merely consist of a baseball attached to a pole by a cord such that one person can rotate the baseball with the pole, while another attempts to hit the baseball with a bat. Other devices tether the baseball on an arm which is rotated by an electric motor. See U.S. Pat. No. 3,762,705 to Gonzalez and U.S. Pat. No. 3,885,790 to Parr, for example.

In contrast to the foregoing, the present invention comprises a water powered rotating baseball device which splashes water upon the batter when contact is made with the ball. Thus the present invention combines a baseball batting device with a device for splashing water on the players during hot summer days.

SUMMARY OF THE INVENTION

The present invention comprises a combination water sprinkler and baseball batting device designed to provide the users with hours of entertainment. Basically, the invention comprises a rotating squirrel cage mounted upon a support, such as a pole. Water from a conventional residential outside spigot is employed to rotate the squirrel cage by impinging a jet of water on the squirrel cage vanes. Positioned atop the squirrel cage is an elongated arm with a baseball at one end and a counterweight at the opposite end.

In the broadest sense of the invention, it comprises a ball, means to tether the ball, means to rotate the tethered ball by water propulsion, and means to support both the tether means and the means to rotate the tethered ball.

DESCRIPTION OF THE PREFERRED EMBODIMENTS

Figure 1:
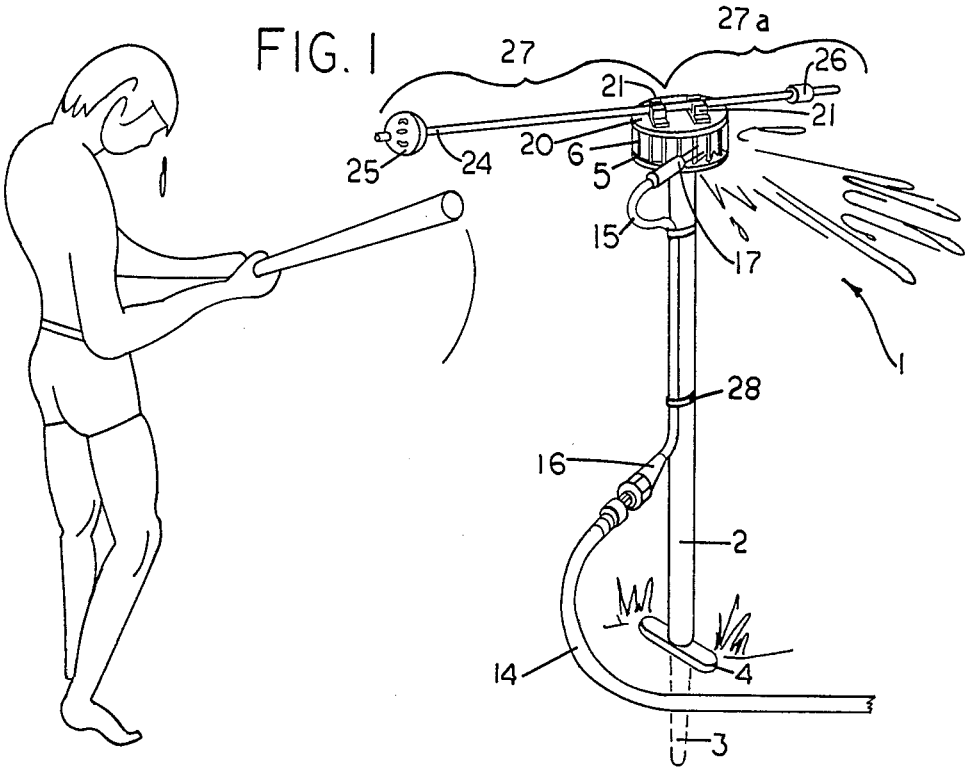
FIG. 1 is a perspective view of the device of the present invention as it is mounted for operation.
Figure 2:
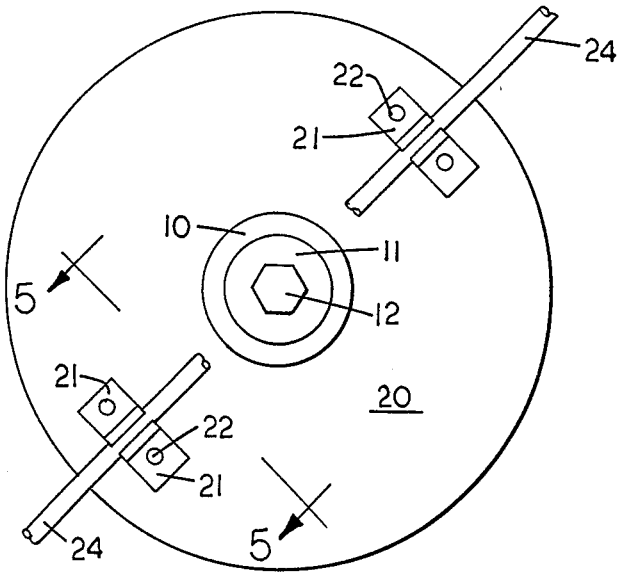
FIG. 2 is an enlarged fragmentary plan view of the device of FIG. 1.

The present invention indicated generally in FIG. 1 by reference numeral 1, includes a hollow support pole 2 having a pointed spike 3 and one or more foot supports 4 at its lowermost end. The pole 2 can be forced into the ground, so that it is self supporting, by vertically positioning the pole 2 with the spike 3 contacting the ground and forcing the spike into the ground by placing one's foot upon the foot support 4 and shoving downwardly until the foot support rests upon the surface of the ground. Thus, the foot support serves not only as a means to project the pole downwardly into the ground, but once the foot support contacts the ground, it provides support to help prevent the pole from tipping laterally.

The upper end of pole 2 mounts a squirrel cage 5 having pockets forming vertical vanes 6, designed to catch the jet spray of water. The shape of the squirrel cage and corresponding vanes may take different forms. For example, the vanes may be cup shaped to catch additional water or planar to more easily fling the water outwardly. The vanes can be closely spaced to provide a large number of narrow pockets, or the vanes may be less densely packed so that the volume of each pocket is greater. The vanes may extend beyond the peripheral edge of the squirrel cage so that some of the water may be flung upwardly and downwardly, as well as outwardly.

Additionally, the squirrel cage may include sound making devices or be designed so that it has a natural resonating frequency when revolving. The squirrel cage also may be designed so that the sound has a progressively higher pitch with a corresponding higher RPM, to enhance the excitement when the device is rotating at full speed.

Figure 4:
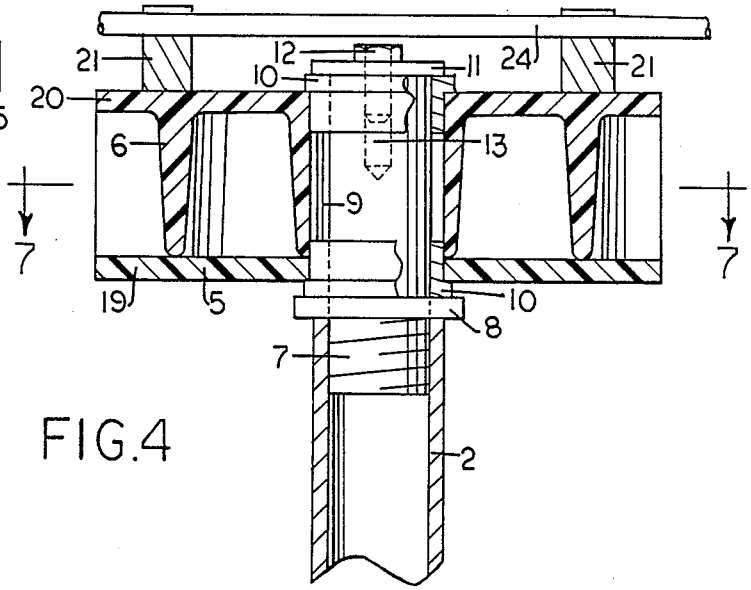
FIG. 4 is an enlarged fragmentary vertical sectional view of the squirrel cage, tether and support pole of the present invention.

As illustrated in FIG. 4, the support pole 2 is hollow and one end of a plug shaft 7 is inserted in its upper end and secured in place by screw threads, adhesive, or the like. Once the plug shaft 7 is firmly secured to support pole 2, a washer 8 is slipped onto the plug shaft. The washer is of a size to fit around the plug shaft, but does not fit around the support pole so that it seats on the upper end of the support pole. Squirrel cage 5 has a central bore 9 which is slightly larger in diameter than plug shaft 7. To provide a rotational fit between the squirrel cage 5 and the plug shaft 7, a pair of flanged bearings 10 is provided, the pair of bearings being friction fitted to each end of central bore 9. The squirrel cage 5 is thus rotatably mounted on the plug shaft 7 with the flange of the lower bearing seated on washer 8. Plug shaft 7 has a threaded bore 13 at its top end. A washer 11, which is of a size to seat on the flange of the upper bearing 10, is secured to plug shaft 7 by bolt 12, as shown in FIG. 4. Bolt 12 is secured in threaded bore 13 in conventional manner, thus fastening the rotating squirrel cage to the support pole. Bearings 10 rotate with squirrel cage 5 while washers 8 and 11, and bolt 12 remain stationary with plug shaft 7 and support pole 2. Preferably, the plug shaft 7, washers 8 and 11, and bearings 10 are made of a self-lubricating material, such as teflon or the like.

Figure 7:
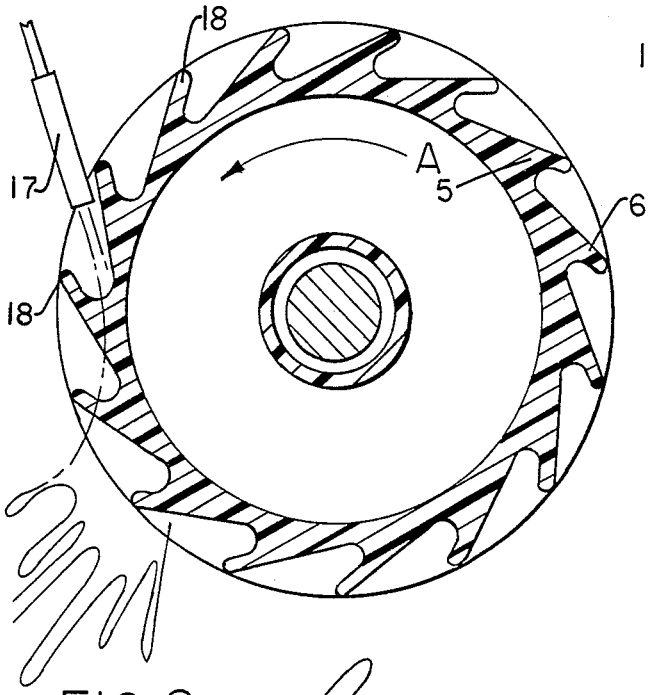
FIG. 7 is a sectional view taken along the line 7—7 of FIG. 4 showing the direction of rotation of the squirrel cage when rotated by the water jet.

An ordinary garden hose 14 is fastened at one end to the residential outdoor spigot in the conventional manner and the other end fastens to conduit 15 which has, at its lower end, a coupling 16 which mates with the fitting on the free end of garden hose 14. The upper end of conduit 15 is fluidly connected to a nozzle 17. Preferably, nozzle 17 comprises a length of flexible plastic tubing of a size to produce a pencil size stream of pressurized water directed at vanes 6 of squirrel cage 5. The flexible plastic tube extends inwardly beyond the peripheral edges 18 of the vanes 6, as run in FIG. 7, so that as the squirrel cage and vanes rotate in the direction indicated by arrow A, the vanes successively deflect the plastic tube outwardly, the deflection of the plastic tube causing the stream of water to be deflected until it is substantially tangent to the periphery of the vanes. Thus, as the plastic tube 17 is deflected, the stream of water becomes more and more tangent to the outer periphery of the squirrel cage, which tends to increase the rotational force and speed of the squirrel cage. Rotation will continue until the batter makes contact with the ball, causing the ball and squirrel cage to rotate in the opposite direction.

Figure 8:
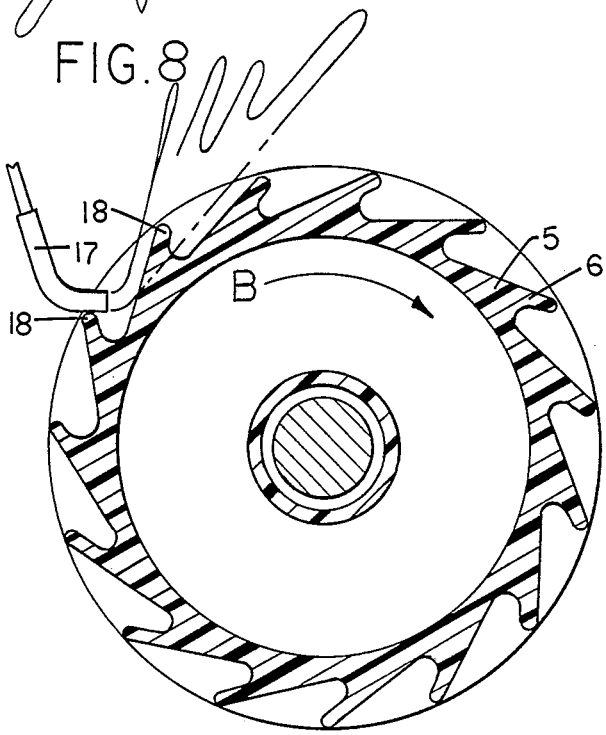
FIG. 8 is a sectional view similar to FIG. 7 showing the movement of the squirrel cage and the nozzle tip when rotated by the batter in a direction opposite to that illustrated in FIG. 7.

When the squirrel cage is rotated in the opposite direction, the peripheral edges 18 of the vanes 6 deflect the plastic tube in the opposite direction, as illustrated in FIG. 8 and indicated by the arrow B. This causes the stream of water to impinge on the trailing surface of each vane, in a substantially perpendicular direction. Because the angle of the vanes with respect to the plastic tubing is essentially perpendicular to the trailing surface of the vanes when oppositely rotated, the water impinging on the vanes is flung outwardly in a wide pattern.

Eventually, the oppositely rotated squirrel cage comes to a stop because of friction and because the peripheral edge of each vane contacts the outer end of the plastic tubing which acts as a brake. As soon as the motion of the squirrel cage is completely arrested, the water stream again takes control and causes the squirrel cage to rotate in its normal water propelled direction.

Squirrel cage 5 consists of a bottom plate 19 and a top plate 20 in addition to vertical vanes 6. The squirrel cage may be integrally molded, or the vanes may be integrally molded with either plate, for example, the top plate as shown in FIG. 4.

Figure 5:
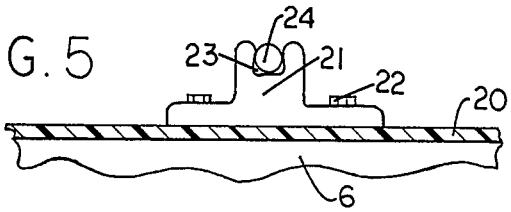
FIG. 5 is a fragmentary elevational view of the upper portion of the squirrel cage taken from the right side of FIG. 4.

Mounted on the top plate 20 of squirrel cage 5 is a pair of tether grips 21 in alignment with one another, as illustrated in FIGS. 1, 4 and 5. The tether grips 21 are secured to the top plate by bolts 22 or the like. Each tether grip 21 has on its upper end a generally U-shaped groove 23 designed to frictionally engage a tether arm 24.

Tether arm 24 has a ball 25 attached at one end and a counterweight 26 attached to the other end. The counterweight serves to balance the weight of the ball 25 and the weight of the length 27 of the tether arm, which is longer than length 27*a*. The counter weight 26 is slidably mounted so that it may be adjusted by sliding it longitudinally along length 27*a* of the tether arm in order to counterbalance the weight of the ball.

Figure 3:
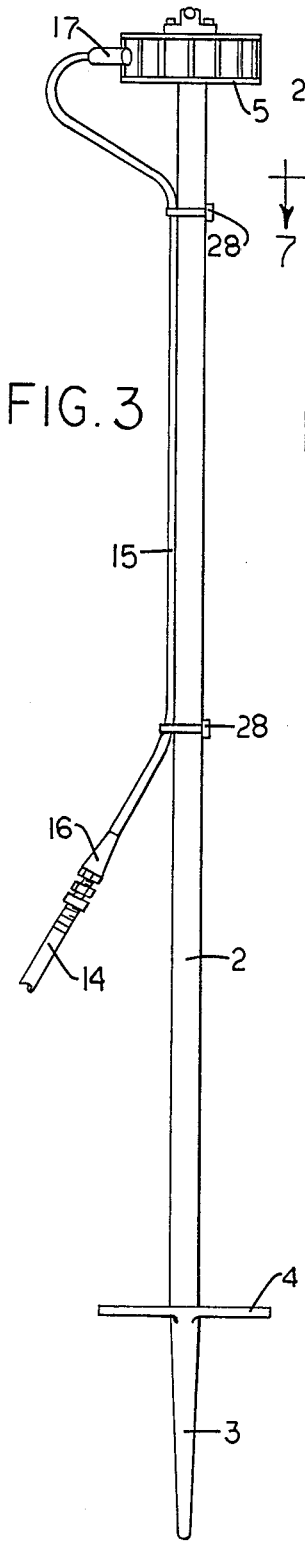
FIG. 3 is a side elevational view of the device of the present invention.
Figure 6:
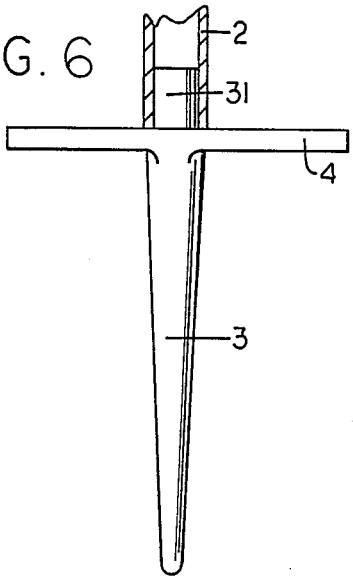
FIG. 6 is a fragmentary elevational view with parts broken away of the lower portions of the support pole.
Figure 9:
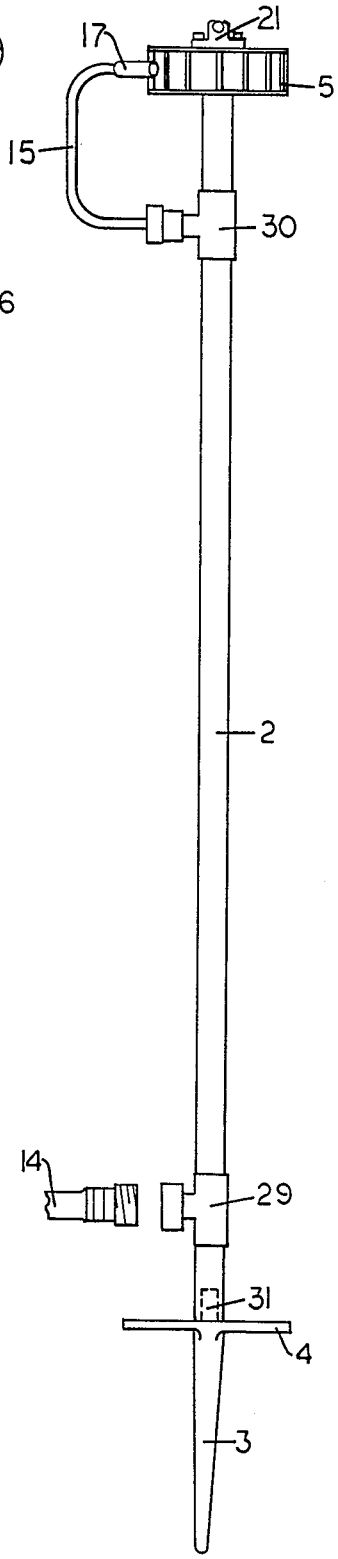
FIG. 9 is a side elevational view of a modification of the device of the present invention.

FIG. 9 illustrates a modification of the invention. In the embodiment of FIG. 3, the conduit 15 is secured to support pole 2 by means of tie clamps 28. In FIG. 9, the hollow support pole 2 includes a pair of T-shaped couplers 29 and 30. The lower coupler 29 is designed to couple with the conventional garden hose 14, to fluidly connect the water to the inside of hollow support pole 2. The upper coupler 30 fluidly connects the hollow support pole 2 to conduit 15. In this manner, water flows from garden hose 14 into coupler 29, upwardly through hollow support pole 2, outwardly through coupler 30, to nozzle 17 via conduit 15. In this modification the lower end of support pole 2 is closed by a plug 31 on the spike 3, as illustrated in FIG. 6, while the upper end of support pole 2 is sealed by plug shaft 7, as illustrated in FIG. 4.

Ball 25 can be a baseball, such as a plastic whiffle ball, a tennis ball, a super ball, a tether ball, a soccer ball, or the like. If a tennis ball is employed, a tennis racket could be used by the "batter" rather than a conventional bat. If a soccer ball is employed, the device could be made to project only a small distance above the surface of the earth. If a tether ball is employed, it may be desirable to mount the ball much higher, like a conventional tether ball.

Arm 24 may be made from many different rigid materials, such as a metal or hard plastic, although preferably it will be resiliant, and the length 27 may have a length of flexible material, such as cord, twine, rope, or flexible plastic attached to its distal end. In particular, when a soccer ball is employed, it is preferable to use a length of rope to prevent the kind of injury that might occur to the legs if a rigid metal or hard plastic were employed.

The entire device can be manufactured from plastic materials which are corrosion proof to environmental conditions and sufficiently light in weight to enable the water jet to rapidly rotate the ball, tether arm and squirrel cage. The spike 3 at the bottom of pole 2 may be made of metal to enable the spiked end to penetrate the earth and to make the foot supports 4 sufficiently rigid to withstand the downward foot pressure necessary to penetrate the earth.

Likewise, the entire device can be made of metal, preferably of non-oxidizing or slow oxidizing metals such as aluminum, brass, copper, stainless steel or chrome-plated metals. Aluminum is preferred since it is both light weight and corrosive resistant to environmental conditions.

In operation, pole 2 is positioned vertically upright, as previously described, by pushing downwardly on foot supports 4 until spike 3 has penetrated the earth a sufficient distance to cause the foot support to rest upon the ground surface. The entire device is now securely positioned in the operating position. An ordinary garden hose 14 is then coupled to conduit 15. When the spigot is turned on, the water from nozzle 17 will impinge upon squirrel cage 5 causing it to rotate. Some minor splashing of water occurs when the water impinges upon the vanes, rotationally propelling the squirrel cage, tether arm and the ball.

As the ball is hit with a bat or the like, the impact causes the squirrel cage, tether arm and ball to rotate in a direction opposite to the water-propelled direction. Because the vanes are cup shaped, they capture the water issuing from nozzle 17 and fling it outwardly in a widely scattering pattern. Additionally, the water impinges on the trailing sides of the vanes which fling the water outwardly in a wide pattern. Thus, the act of hitting the ball and causing the squirrel cage to rotate in an opposite direction rewards the batter by flinging cool water spray upon the batter.

After the ball has been hit, the water spray operates to inhibit rotation of the squirrel cage because it impinges upon each vane as it rotates toward the water spray. Additionally, the plastic tube, which contacts each vane, aids in arresting the rotational motion of the squirrel cage. Eventually, the rotation halts and the water spray begins to take control once again, causing the cage to rotate in the water-propelled direction. When the ball is hit again, the entire sequence will repeat itself. Thus, the present invention provides an amusement device designed to be used during hot summer days to develop hand-eye coordination and to reward the accurate batter by spraying the batter with cool water.

Modifications may be made in the invention without departing from its spirit and purpose. For example, if it is desired to use the device on a pavement, the spike 3 may be replaced by a weighted pedestal having a socket to receive the pole 2, or the pole can be provided with a tripod or other similar mounting means.

What is claimed is:

1. An amusement device for improving physical coordination of a user and to cool a user with a spray of water, said device comprising:

(1) a ball;

(2) means to tether said ball;

(3) means to rotate said tether means by water propulsion in one direction; and (4) means to support both said means to tether and said means to rotate, said means to rotate including spray means so that when a user strikes said ball in a manner opposed to said one direction, said means to rotate flings water outwardly therefrom in a spray.

2. The device of claim 1, wherein said ball is made of plastic or rubber.

3. The device of claim 1, wherein said means to tether includes an arm which is attached to said means to rotate, wherein said arm is secured to said ball.

4. The device of claim 3, wherein said arm includes a long portion and a short portion.

5. The device of claim 4, wherein said long portion is attached to said ball.

6. The device of claim 4, wherein said short portion is attached to a counterweight.

7. The device of claim 6, wherein said counterweight is adjustable by being longitudinally slidable on the short portion of said arm.

8. The device of claim 1, wherein said spray means includes vertical vanes.

9. The device of claim 8, wherein said vertical vanes are integrally formed with a squirrel cage.

10. The device of claim 8, wherein said vertical vanes are cup-shaped.

11. The device of claim 8, wherein said spray means includes a spray nozzle whose spray impinges on said vertical vanes, causing said vanes to rotate.

12. The device of claim 1, wherein said means to support comprises a pole adapted to be anchored in the ground.

13. A ball batting device for improving hand-eye coordination of a user and to cool a user with a spray of water, said device comprising: a vertical support, a squirrel cage rotatably mounted on said support for rotation about a vertical axis, a spray nozzle for directing a stream of water against said squirrel cage to rotate it in one direction, a tether secured to said squirrel cage for rotation therewith, and a ball secured to said tether for rotation by said tether, so that when a user strikes said ball with a bat in a manner opposed to said one direction, said squirrel cage flings water outwardly in the form of a circular spray.

14. The ball batting device claimed in 13 wherein said squirrel cage comprises a plurality of vanes defining pockets there between, and wherein said spray nozzle comprising a flexible nozzle member positioned to project inwardly into said pockets, said flexible nozzle member being deflectable by said vanes as said squirrel cage is rotated.

15. The ball batting device claimed in claim 14, wherein said flexible nozzle member is positioned to be deflected in opposite directions depending upon the direction of rotation of said squirrel cage.

16. The ball batting device claimed in claim 15 wherein the stream of water from said flexible nozzle acts to accelerate rotation of said squirrel cage when said nozzle is deflected in said one direction, and acts to retard rotation of said squirrel cage when deflected in the opposite direction.

* * * * *